United States Patent [19]

Abbott et al.

[11] Patent Number: 4,590,460

[45] Date of Patent: May 20, 1986

[54] STAIRWELL SECURITY SYSTEM

[76] Inventors: Ralph E. Abbott, 26 Fort Pond Rd., Acton, Mass. 01720; Ronald J. Massa, 16 Beverly Rd., Bedford, Mass. 01730

[21] Appl. No.: 657,161

[22] Filed: Oct. 3, 1984

[51] Int. Cl.[4] ..... G08B 13/08; G08B 13/18

[52] U.S. Cl. ..... 340/541; 340/309.15; 340/522; 340/545; 340/567

[58] Field of Search ..... 340/541, 545, 547, 567, 340/522, 309.15

[56] References Cited

U.S. PATENT DOCUMENTS

| | | | |
|---|---|---|---|
| 2,198,725 | 4/1940 | Smith | 340/567 |
| 2,912,540 | 11/1959 | Sawicki | 340/547 |
| 4,377,808 | 3/1983 | Kao | 340/522 |
| 4,442,359 | 4/1984 | Lederer | 340/567 |

*Primary Examiner*—Glen R. Swann, III

*Attorney, Agent, or Firm*—Joseph S. Iandiorio

[57] ABSTRACT

A security system includes an entry monitoring sensor for detecting movement into a first space, a first area monitoring sensor for detecting occupancy in the first space, at least one area monitoring sensor for detecting occupancy in at least one space adjacent the first space. The system further includes a timing device for measuring a first time period in response to actuation of the entry sensor and for measuring a second time period in response to the actuation of the first area sensor during the first time period. An alarm device indicates any suspicious occupancy at the expiration of the second time period in the absence of detection of occupancy by at least one of the area sensors for detecting occupancy in at least one space adjacent the first space.

26 Claims, 4 Drawing Figures

STAIRWELL SECURITY SYSTEM

FIELD OF INVENTION

This invention relates to a security system for monitoring entry and occupancy of a secured area and distinguishing between suspicious and non-suspicious occupancy thereof.

BACKGROUND OF INVENTION

Security is a serious problem in all types of buildings, e.g. commercial, industrial, office, residential, parking garages, transportation facilities, hotels, hospitals, and others. Prompt detection and location of an intrusion, threat or unauthorized occupant is crucial. Traditional security systems are arranged to go into alarm if any one or more detectors are activated. They are thus of very limited value during periods of occupancy when the sensors are likely to be activated by legitimate occupants. Moreover, once alarmed these systems provided little, if any, further information about changes in the situation which caused the alarm. Many such security systems are simply turned off when the monitored areas must be occupied by legitimate persons.

A more useful security system would be one in which monitored areas could be freely used by legitimate occupants at any time, but which would quickly recognize suspicious or non-authorized presence or activity and provide precise location of the threatening occupancy before and after an alarm is created. Such a system would ideally be passive, that is it would require no special keys, cards, combinations, or other overt actions on behalf of legitimate occupants.

Stairwells are particularly notorious areas for staging crimes against persons and property: theft, burglary, robbery, rape, mugging and the like. Generally, facilities are easily entered during the day. An intruder can hide in a stairwell until activity subsides and then enter the building and move freely about. The relative privacy and confinement of stairwells are particularly attractive to muggers and rapists.

Unfortunately, fire and safey codes often conflict with good security practices: one-way doors which allow only entry into stairwells on upper floors and exit at only the street floor are increasingly prohibited by local building codes.

Conventional security systems often use only magnetic switches on each door of each stairwell in a building. In a typical forty story building with four stairwells, a guard at a central control console must monitor 160 door switches. A typical switch signals a guard who notes the time on a computerized logging system. If the doors are one-way only, they cannot be used by those legitimately traveling between floors without using the elevator. There is no information provided as to whether someone is in the stairwell and, if he is, whether or not his occupancy is suspicious or normal.

SUMMARY OF INVENTION

It is therefore an object of this invention to provide an improved security system which can detect occupancy as well as entry of a secured area.

It is a further object of this invention to provide such a security system which can distinguish between suspicious and non-suspicious occupancy in a secured area.

It is a further object of this invention to provide such a security system which can accommodate normal use of the secured area.

It is a further object of this invention to provide such a security system which can precisely locate the suspicious or non-suspicious occupancy.

It is a further object of this invention to provide such a security system which can monitor an unlimited number of adjacent areas and entries.

It is a further object of this invention to provide such a security system which is particularly well adapted for stairwell surveillance.

The invention results from the realization that a truly effective security system for detecting occupancy and distinguishing suspicious and non-suspicious occupancy in a secured area can be accomplished by monitoring both entry to and progress through secured areas within defined time periods. The invention has the unique ability to distinguish between suspicious and legitimate occupants of the same space during normal use and occupancy twenty-four hours a day and to precisely locate both legitimate and suspicious persons, even after an alarm condition is generated. It also has the unique ability to distinguish between suspicious and legitimate occupants passively. That is, no keys, combinations, card access or other overt actions or accessories are required for the system to perform. The logic is based upon monitoring an occupant's compliance with behavior that defines legitimate occupancy, i.e. the system recognizes patterns of occupancy.

The invention features a security system including an entry monitoring sensor for detecting movement into a first space and a first area monitoring sensor for detecting occupancy in the first space. There is at least one area monitoring sensor for detecting occupancy in at least one space adjacent the first space. There are timing means for measuring a first time period in response to actuation of the entry sensor and for measuring a second time period in response to actuation of the first area sensor during the first time period. Alarm means indicate a suspicious occupancy at the expiration of the second time period in the absence of detection of occupancy by at least one area sensor for detecting occupancy in at least one space adjacent the first space. For the preferred embodiment, the entry monitoring sensor may be an infrared sensor and the entry monitoring sensor may produce a vertical zone of infrared sensitivity. The first area monitoring sensor may also be a infrared sensor and may produce a horizontal zone of infrared sensitivity. That horizontal zone of infrared sensitivity may include a plurality of spaced fingers of infrared sensitivity separated by areas of infrared insensitivity. The entry monitoring sensor may also be a magnetic switch. There are means for indicating a non-suspicious occupancy during the period of the second timing means. The first time period is approximately five (5) seconds and the second time period is approximately twenty (20) seconds. The alarm means is inhibited from indicating an alarm condition in response to a second actuation of the entry monitoring sensor when it occurs within the second time period. The first area monitoring sensor may include means for detecting an intrusion into a first finger of the horizontal zone of infrared sensitivity and a means for detecting a further intrusion into a second finger of the horizontal zone of infrared sensitivity. The timing means may respond to a second intrusion actuation of the first area sensor. In a preferred embodiment, the security system may be adapted as a stairwell security system having a door monitoring sensor for detecting movement through a stairwell door and a first area monitoring sensor for detecting occupancy in the stairwell proximate the door. There is a second stairway monitoring sensor for detecting occupancy in the stairwell proximate the next higher door and a third stairway monitoring sensor for detecting occupancy in the stairwell proximate the next lower door. There are first timing means for measuring a first time period in response to actuation of the door sensor and second timing means measure a second time period in response to actuation of the first stairway sensor during the first time period. Alarm means indicate a suspicious occupancy at the expiration of the second time period in the absence of detection of occupancy by one of the second and third stairway monitoring sensors during the second time period.

BRIEF DESCRIPTION OF THE DRAWINGS

Other objects, features and advantages will occur from the following description of a preferred embodiment and the accompanying drawings, in which.

DESCRIPTION OF PREFERRED EMBODIMENTS

The invention may be used in a stairwell security system in which two passive infrared sensors are used, one as a door sensor which provides a vertical zone or curtain of infrared sensitivity, and the second as a stairwell sensor which provides a horizontal zone of infrared sensitivity. Alternatively, the infrared door sensor may be replaced by a magnetic switch and the stairwell sensor may be replaced by some other presence or motion sensor or device. The security system processor may be implemented with a microprocessor having a stored program or specific digital logic such as CMOS hardware, or software alone which is used in the host computer of the larger security network of which this system may form a part. The output of the processor may be fed to visual and/or audible alarms or indicators, or may be used to drive printers, CRT's or a host computer, or it may be used to provide input to remote security monitoring stations at a local or remote facility.

Figure 1:
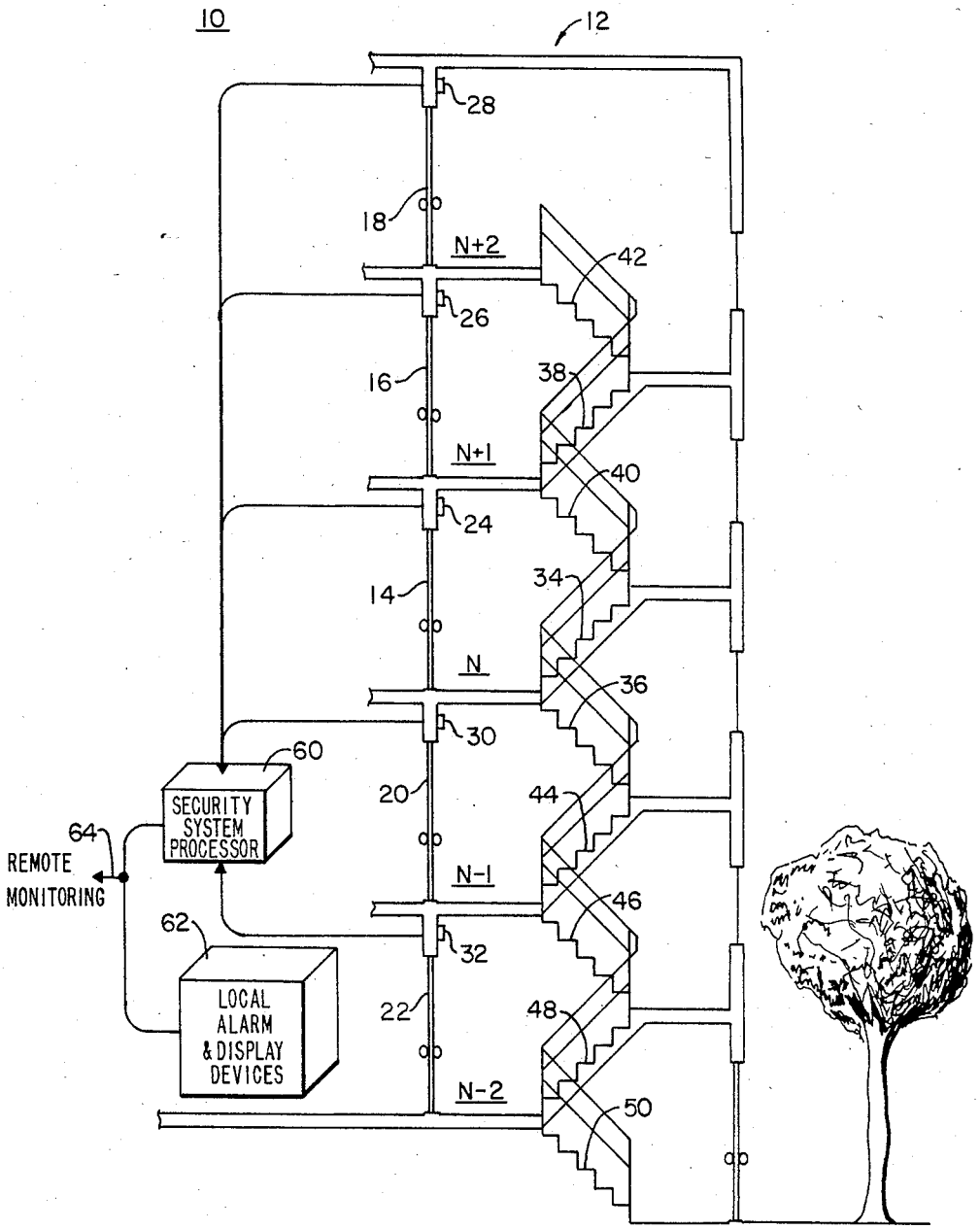
FIG. 1 is a schematic diagram of a stairwell having a plurality of floors using the security system according to this invention.

A security system 10, FIG. 1, according to this invention may be used to protect the stairwell 12 of a conventional building having five floors, designated for example as N−2, N−1, N, N+1, N+2, as shown. Each floor has a door 14, 16, 18, 20 and 22, which accesses the stairwell. Associated with each door is a monitoring unit 24, 26, 28, 30 and 32. Each monitoring unit includes a door sensor and a stairway sensor. The door sensor detects the opening of its associated door; the stairway sensor detects movement on the two most closely associated flights of stairs. For example, monitoring unit 24 associated with door 14 on floor N includes a door sensor which detects the opening of door 14 and a stairway sensor which detects motion on stairway 34 and on stairway 36. Similarly, the stairway sensor of monitoring unit 26 detects motion on stairways 38 and 40 and the stairway sensor in monitoring unit 28 detects motion on stairway 42. There is no second stairway to be monitored by the stairway sensor of monitoring unit 28. Instead the system is programmed with a dummy stairway, which of course never has any motion on it, in order to maintain the symmetry of the circuitry or the software which implements the system and thereby contribute to the overall modularity of the system. In a similar fashion, a phantom or dummy flight may be used at the lower floor if the lower flight is missing. That is not the case in the example shown in FIG. 1, since the stairway sensor of monitor unit 30 monitors stairways 44 and 46 and the stairway sensor of monitor unit 32 monitors stairways 48 and 50. The outputs of the various monitor units 24, 26, 28, 30 and 32 are fed directly to security system processor 60 which determines whether or not there is an occupancy and where, and whether or not the occupancy is legitimate or suspicious. Following on that decision, processor 60 provides an output to local alarm and display devices 62 and, if desired, to remote monitoring devices over line 64.

Figure 2:
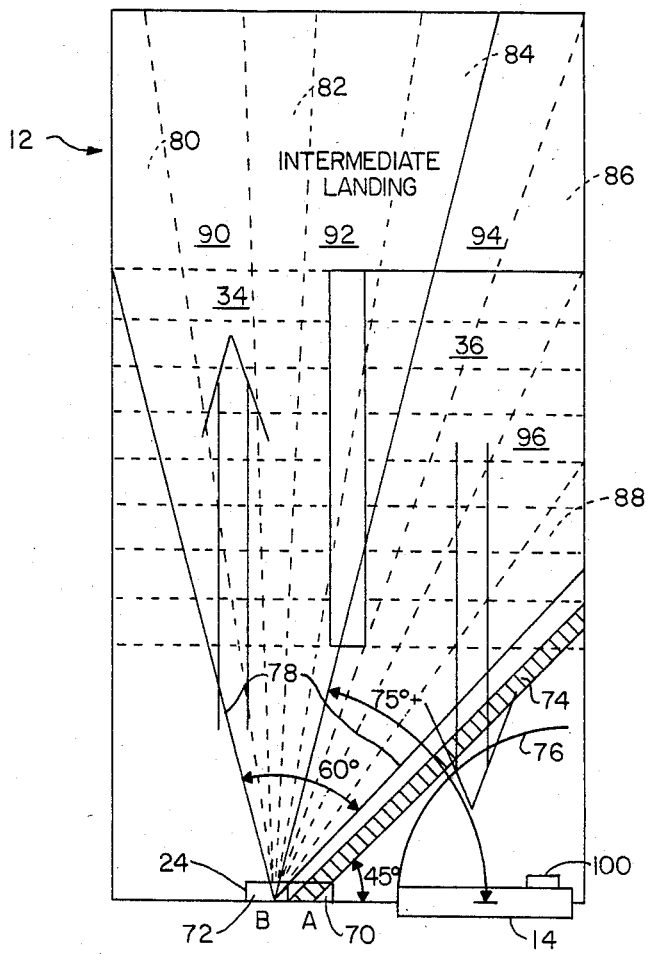
FIG. 2 is a schematic plan view showing the fields of sensitivity of the door sensor and stairway sensors used in FIG. 1.

Each monitoring unit is exemplified by monitoring unit 24, FIG. 2 associated with door 14. It includes two sensors, the door sensor 70, also referred to as the A sensor, and the stairway sensor 72, also referred to as the B sensor. The A sensor is a passive infrared sensor such as the model DR-301 manufactured and sold by Aritech Corporation, Framingham, Mass. Sensor 70 produces a vertical curtain or zone of infrared sensitivity as indicated by the bar 74, so that as door 14 is opened through the arc 76 an entering person must necessarily interfere with the infrared zone 74 and produce an A signal, in this case the $A_N$ signal. Stairway or B sensor 72 is a passive infrared sensor such as a DR-321 model manufactured and sold by Aritech Corporation, Framingham, Mass. which provides a horizontal sheet or zone indicated at 78, which covers both the downward flight 36 and the upward flight 34 from floor N. Sheet or zone 70 may be a complete sector of uniform infrared sensitivity, or it may be composed of a plurality of fingers 80, 82, 84, 86, 88 of sensitive areas interspersed with areas 90, 92, 94 and 96 of little or no sensitivity. When this approach is used, instead of the uniform sensitivity across the entire zone, the progress of a person moving from finger to finger can be more easily detected. The infrared door sensor 70 may in some applications be replaced by a magnetic door switch 100.

Figure 3:
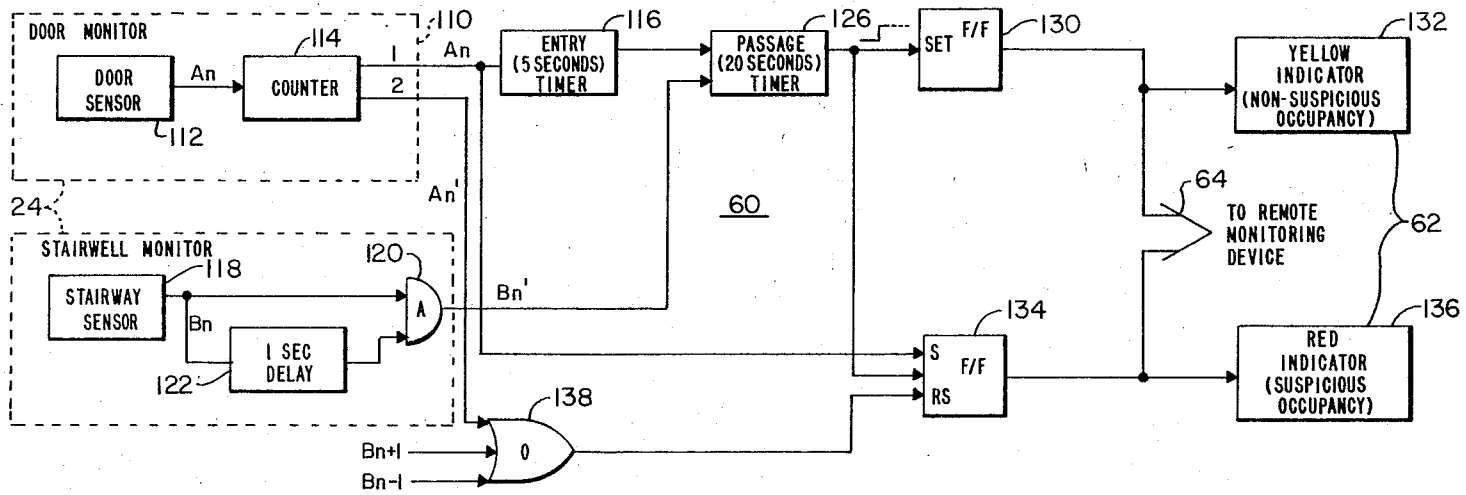
FIG. 3 is a simplified block diagram of the security system processor circuit according to this invention.

Security system processor 60 may be implemented using a door monitor 110, FIG. 3, which includes an infrared door sensor 112 that provides a sign $A_N$ when the door is opened to a counter 114. Upon the first opening of the door, the $A_N$ signal is provided on line 1 to a five second entry timer 116. Monitoring unit 24 also includes an infrared stairway sensor 118 which, when it senses motion on stairway 34 or 36, provides a $B_N$ signal to AND gate 120. The $B_N$ signal is delayed by one second by delay 122 before it is submitted to AND gate 120. If a second movement is detected by stairway sensor 118 at the end of that one-second period, both inputs to AND gate 120 are present and a $B_N'$ signal is provided on line 124 to 20-second passage timer 126. If the $B_N'$ signal occurs at the end of the five-second period established by entry timer 116, then passage timer 126 is enabled and begins to measure its twenty second period.

Physically, the first $B_N$ signal represents an entry from door 14 into the first finger 88 of infrared sensitivity, as shown in FIG. 2. The second $B_N$ signal which causes the $B_N$ prime signal to be generated represents further movement of the person into the second finger of sensitivity 86. When the first $A_N$ signal is provided to entry timer 116 indicating a person has entered through door 14, a signal is provided after five seconds to passage timer 126. When passage timer 126 begins to measure its twenty second period, it provides a signal to set flip-flop 130 which illuminates a yellow indicator 132 to indicate that there is an occupancy, but that it is presently non-suspicious. That signal may also be relayed over line 64 to a remote monitoring device.

At the time that $A_N$ signal is provided to entry timer 116 to begin its five-second interval, the same $A_N$ signal is sent to set flip-flop 134. If passage timer reaches its twenty second limit before flip-flop 134 is reset, a signal is sent to red indicator 136 to indicate that there is an occupancy and that it is suspicious, and the same signal may be sent on line 64 to a remote monitoring device. However, if before the end of the twenty second interval of passage timer 126 a reset signal is delivered to flip-flop 134, the red indicator 136 will not be triggered. Any one of three signals may reset flip-flop 134 and prevent the indication of suspicious occupancy by red indicator 136. For example, if a second door opening occurs to produce an $A_N'$ signal from the second count output of counter 114 to OR gate 138, flip-flop 134 will be reset. This indicates that after entering, the person turned around, and once again opened the door and exited. In addition, if the stairway sensor on either the floor above or the floor below senses the person moving on its respective stairway, that is if a $B_{N+1}$ or $B_{N-1}$ signal is provided to OR gate 138, flip-flop 134 will also be reset and prevent the suspicious occupancy indication by the energization of red indicator 136. In that case, the determination has been made that the person who entered door 14 is now moving either up or down to another floor in a legitimate manner.

Figure 4:
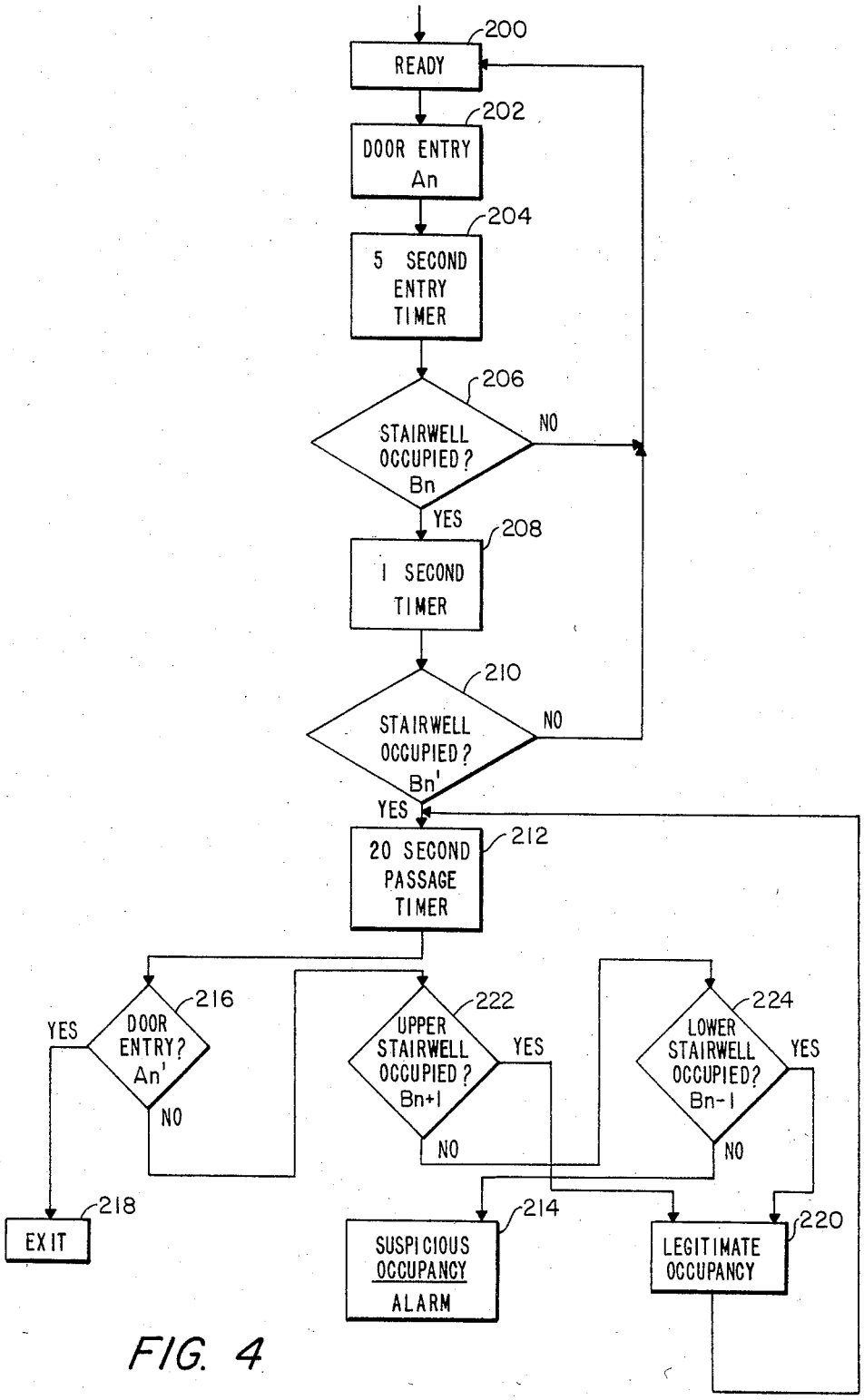
FIG. 4 is a flow chart of software used in a microprocessor to implement the security system of this invention.

Instead of a hardware implementation, as shown in FIG. 3, security system processor 60 may be implemented with a conventional microprocessor such as the Z-80 8-bit microprocessor by Zilog, programmed according to the flow chart of FIG. 4. With the system in the "ready" state 200, a door entry occurs in step 202 and produces an $A_N$ signal. This activates a five-second entry timer in step 204, following which the question is asked: "Is stairwell occupied?" in step 206. If the answer is "no", the system recycles to the "ready" state in step 200. If the answer is "yes", a $B_N$ signal is developed and a one-second timer is set in step 208. The question is then asked again in step 210: "Is the stairwell occupied?". If it is not, the system is once again returned to the "ready" state in step 200. If it is occupied, then the $B_N'$ signal is developed and the 20-second passage timer is activated in step 212. At the end of the 20-second time measured by step 212 a suspicious occupancy alarm is produced in step 214 unless the occupancy can be otherwise accounted for. For example, in step 216 the question is asked: "Has there been another door opening or entry?". If there has and the signal $A_N'$ has been developed, then it is determined in step 218 that the person has exited. If the answer is "no", then this may be a suspicious occupancy. However, step 222, the question still must be asked: "Is the upper stairwell occupied?". If it is and there is a $B_{N+1}$ signal, then this may be a legitimate occupancy as indicated in step 220. However, if the answer is "no", there is still the possibility that this may be a suspicious occupancy. Finally, step 224, the question is asked: "Is the lower stairwell occupied?". If the answer is "yes", the $B_{N-1}$ signal has been found and there is a legitimate occupancy, but if the answer to this question also is "no" then all three questions have been answered "no" and there is a suspicious occupancy alarm produced at step 214. A detection producing a $B_N$ signal which has not been preceded within 20 seconds by an $A_N$, $B_{N+1}$ or $B_{N-1}$ signal causes a red alarm denoting suspicious occupancy.

Other embodiments will occur to those skilled in the art and are within the following claims.

What is claimed is:

1. A stairwell security system comprising:

a door monitoring sensor for detecting movement through a stairwell door;

a first stairway monitoring sensor for detecting occupancy in the stairwell proximate the door;

a second stairway monitoring sensor for detecting occupancy in the stairwell proximate the next higher door;

a third stairway monitoring sensor for detecting occupancy in the stairwell proximate the next lower door;

timing means for measuring a first time period in response to activation of said door sensor and for measuring a second time period in response to activation of said first stairway sensor during said first time period; and alarm means for indicating a suspicious occupancy at the expiration of said second time period in the absence of detection of occupancy by one of said second and third stairway monitoring sensors.

2. The security system of claim 1 in which said door monitoring sensor is an infrared sensor.

3. The security system of claim 2 in which said door monitoring sensor produces a vertical zone of infrared sensitivity.

4. The security system of claim 1 in which said first stairway monitoring sensor is an infrared sensor.

5. The security system of claim 4 in which said first stairway monitor sensor produces a horizontal zone of infrared sensitivity.

6. The security system of claim 5 in which said horizontal zone of infrared sensitivity includes a plurality of spaced fingers of infrared sensitivity separated by areas of infrared insensitivity.

7. The security system of claim 1 in which said door monitoring sensor is a magnetic switch.

8. The security system of claim 1, further including means for indicating a non-suspicious occupancy during said second time period.

9. The security system of claim 1 in which said first time period is approximately five seconds.

10. The security system of claim 1 in which said second time period is approximately twenty seconds.

11. The security system of claim 1 in which said alarm means is inhibited from indicating an alarm condition in response to a second actuation of said door monitoring sensor within said second time period.

12. The security system of claim 6 in which said first stairway monitoring sensor includes means for detecting an intrusion into a first finger of said horizontal zone of infrared sensitivity and means for detecting a further intrusion into a second finger of said horizontal zone of infrared sensitivity.

13. The security system of claim 12 in which said timing means responds to the second activation of said first stairway sensor.

14. A security system comprising:

an entry monitoring sensor for detecting movement into a first space;

a first area monitoring sensor for detecting occupancy in said first space;

at least one adjacent area monitoring sensor for detecting occupancy in at least one space adjacent said first space;

timing means for measuring a first time period in response to actuation of said entry sensor and for measuring a second time period in response to actuation of said first area sensor during said first time period; and alarm means for indicating a suspicious occupancy at the expiration of said second time period in the absence of detection of occupancy by said adjacent area sensor for detecting occupancy in at least one space adjacent said first space.

15. The security system of claim 14 in which said entry monitoring sensor is an infrared sensor.

16. The security system of claim 15 in which said entry monitoring sensor produces a vertical zone of infrared sensitivity.

17. The security system of claim 14 in which said first area monitoring sensor is an infrared sensor.

18. The security system of claim 17 in which said first area monitor sensor produces a horizontal zone of infrared sensitivity.

19. The security system of claim 18 in which said horizontal zone of infrared sensitivity includes a plurality of spaced fingers of infrared sensitivity separated by areas of infrared insensitivity.

20. The security system of claim 14 in which said entry monitoring sensor is a magnetic switch.

21. The security system of claim 14, further including means for indicating a non-suspicious occupancy during said second time period.

22. The security system of claim 14 in which said first time period is approximately five seconds.

23. The security system of claim 14 in which said second time period is approximately twenty seconds.

24. The security system of claim 14 in which said alarm means is inhibited from indicating an alarm condition in response to a second actuation of said entry monitoring sensor within said second time period.

25. The security system of claim 19 in which said first area monitoring sensor includes means for detecting an intrusion into a first finger of said horizontal zone of infrared sensitivity and means for detecting a further intrusion into a second finger of said horizontal zone of infrared sensitivity.

26. The security system of claim 25 in which said timing means responds to the second actuation of said first area sensor.

* * * * *